US007081742B2

(12) United States Patent
Ito et al.

(10) Patent No.: US 7,081,742 B2
(45) Date of Patent: Jul. 25, 2006

(54) POWER SUPPLY APPARATUS PROVIDED WITH OVERCURRENT PROTECTION FUNCTION

(75) Inventors: Tomoyuki Ito, Kyoto (JP); Isao Yamamoto, Kyoto (JP); Hiroyuki Iwaki, Yokohama (JP)

(73) Assignee: Rohm Co., Ltd. (JP)

( * ) Notice: Subject to any disclaimer, the term of this patent is extended or adjusted under 35 U.S.C. 154(b) by 0 days.

(21) Appl. No.: 11/151,920

(22) Filed: Jun. 14, 2005
(Under 37 CFR 1.47)

(65) Prior Publication Data

US 2005/0275391 A1 Dec. 15, 2005

(30) Foreign Application Priority Data

Jun. 14, 2004 (JP) ..... 2004-174884
May 11, 2005 (JP) ..... 2005-139131

(51) Int. Cl.
*G05F 1/56* (2006.01)

(52) U.S. Cl. ..... 323/273; 323/277

(58) Field of Classification Search ..... 323/265, 323/273, 276, 277, 280, 281
See application file for complete search history.

(56) References Cited

U.S. PATENT DOCUMENTS 4,401,936 A * 8/1983 van Opijnen ..... 320/127
4,560,918 A * 12/1985 Callen ..... 323/273
4,899,098 A * 2/1990 Gariboldi ..... 323/277
6,710,584 B1 * 3/2004 Kuroiwa et al. ..... 323/281
6,972,547 B1 * 12/2005 Murakami ..... 323/267

FOREIGN PATENT DOCUMENTS

JP 2003-173211 6/2003

* cited by examiner

*Primary Examiner*—Adolf Berhane
(74) *Attorney, Agent, or Firm*—Cantor Colburn LLP

(57) ABSTRACT

A series regulator for outputting a regulated voltage and a booster circuit of a charge pump type for outputting an output voltage by boosting the regulated voltage are connected in series. The series regulator is controlled so that the output voltage is maintained constant. A main circuit current of the series regulator is subject to current limitation. An excess signal commensurate of an excess of a current indicator value over a current reference value is generated. A voltage control signal is reduced in level in accordance with the excess signal.

16 Claims, 3 Drawing Sheets

POWER SUPPLY APPARATUS PROVIDED WITH OVERCURRENT PROTECTION FUNCTION

BACKGROUND OF THE INVENTION

1. Field of the Invention

The present invention relates to a power supply apparatus which regulates an input voltage from a power source such as a battery so as to generate a predetermined output voltage and which protects against an overcurrent.

2. Description of the Related Art

A power supply apparatus of a series type, capable of generating a predetermined output voltage fed to a load and limiting a load current to a predetermined value, is known in the related art (patent document No. 1).

Referring to FIG. 1 of the patent document No. 1, the power supply apparatus of a series type is configured such that a control transistor P1 is provided between an input terminal and an output terminal. The control transistor P1 is controlled by an operational amplifier OP1 operated on the basis of an output voltage Vo and a reference voltage Vref1 so that the output voltage Vo maintained to be constant is supplied to a load Z1. There is also provided a current detection transistor P2, which is controlled concurrently with the control transistor P1 by the same control signal as the that of the control transistor P1. With this arrangement, a current indicator value Vb proportional to an output current is detected. A comparator COMP1 compares the current indicator value Vb with a predetermined current limit value Vref2. When the current indicator value exceeds the current limit value, a comparison output is generated so that the control transistor P1 is turned off.

[Patent document No. 1 ]

JP2003-173211

With the related-art power supply apparatus of patent document No. 1, a predetermined output voltage generated from an input voltage is supplied to a load. An excessive output current is limited to a predetermined value even when a failure such as a short circuit at the load occurs.

The power supply apparatus of patent document No. 1 generates a comparison output when the current indicator value exceeds the current limit value so as to turn the control transistor off. As such, the related-art apparatus is incapable of supplying an output current in excess of a level commensurate with the current limit value to the load, even when the output voltage is permitted to be lower than the predetermined voltage, or when the load is heavy, for example. Another disadvantage is that, since the gain in an overcurrent limiting operation is high, a voltage drop in a output voltage vs. output current plot (drop characteristic) is steep. This results in an increased possibility of oscillation occurring in the current limiting operation.

Further, the same control signal as used to control the control transistor is used to control the current detection transistor for simultaneous control in the power supply apparatus of patent document No. 1. Therefore, the overcurrent limiting operation cannot be controlled independent of an operation for controlling the control transistor.

SUMMARY OF THE INVENTION

Accordingly, an object of the present invention is to provide a power supply apparatus in which is used a power supply of a series type, capable of regulating an input voltage to generate a predetermined output voltage supplied to a load and limiting a load current to a predetermined value, or a combination of a power supply of a series type and a booster circuit of a charge pump type, wherein a load current in excess of a current limit value is supplied in a stable manner, and oscillation is prevented from occurring in a current limiting operation.

The present invention according to one aspect provides a power supply apparatus. The power supply apparatus according to this aspect comprises: a control transistor which is controlled by a voltage control signal and which outputs an output voltage by regulating an input voltage; a constant voltage control circuit which receives a predetermined voltage reference value and a voltage indicator value commensurate with the output voltage, and which generates the voltage control signal in accordance with a difference between the voltage reference value and the voltage indicator value; a current detection resistor provided in a current path of the control transistor; a current detection circuit which generates a current indicator value commensurate with a voltage drop in the current detection resistor; and an excess signal generation circuit which receives the current indicator value and a predetermined current limit reference value, generates an excess signal commensurate with an excess of the current indicator value over the current limit reference value, and controls the voltage control signal in accordance with the excess signal.

According to this aspect, the excess signal commensurate with an excess of the current indicator value over the current limit reference value is generated. By controlling the voltage control signal in accordance with the excess signal, it is ensured that the slope of the dropping characteristic in an overcurrent limiting operation is gentle. Unlike the steep dropping characteristic of the related art, the inventive dropping characteristic ensures that a load current in excess of the current limit value continues to be supplied in a stable manner in case the output voltage is permitted to be lower than a predetermined value, i.e., when the load is heavy, for example.

The present invention according to another aspect also provides a power supply apparatus. The power supply apparatus according to this aspect comprises: a control transistor which is controlled by a voltage control signal and which outputs a regulated voltage by regulating an input voltage; a booster circuit of a charge pump type which receives the regulated voltage and boosts the regulated voltage so as to output an output voltage accordingly; a constant voltage control circuit which receives a predetermined voltage reference value and a voltage indicator value commensurate with the output voltage, and which generates the voltage control signal in accordance with a difference between the voltage reference value and the voltage indicator value; a current detection resistor provided in a current path of the control transistor; a current detection circuit which generates a current indicator value commensurate with a voltage drop in the current detection resistor; and an excess signal generation circuit which receives the current indicator value and a predetermined current limit reference value, generates an excess signal commensurate with an excess of the current indicator value over the current limit reference value, and controls the voltage control signal in accordance with the excess signal.

According to this aspect, a series regulator including a control transistor for regulating an input voltage and outputting a regulated voltage, and a booster circuit of a charge pump type for boosting the regulated voltage to output an output voltage are connected in series. The series regulator is controlled so as to maintain the output voltage at a constant level. A main circuit current of the series regulator (not an output current from the booster circuit of a charge pump type) is subject to current limitation. With this, the output voltage is controlled to be constant, and the series regulator is protected from an overcurrent. Further, even when an input voltage from a battery power source drops, a predetermined output voltage continues to be output from the booster circuit of a charge pump type.

The excess signal generation circuit may shift the voltage control signal in a direction in which the control transistor is turned off, in accordance with the excess signal. Since the control transistor is controlled in a direction in which it is turned off when the current indicator value exceeds the current reference value, the output voltage is lowered.

The constant voltage control circuit may comprise: a first differential amplifier circuit which amplifies a difference between the voltage reference value and the voltage indicator value; and a voltage control signal generation transistor which is controlled by an output of the first differential amplifier circuit so as to generate the voltage control signal.

The current detection circuit may comprise: a first resistor which is connected in series between an end of the current detection resistor and a reference potential node; a conversion transistor; a second resistor; and an operational amplifier which receives a potential difference between a node connecting the first resistor and the conversion transistor and the other end of the current detection resistor, and which controls the conversion transistor by an output of the operational amplifier, wherein a voltage drop in the second resistor is used as the current indicator value. In this case, a current commensurate with a current that flows through the current detection resistor flows through the first resistor, the conversion transistor and the second resistor. Accordingly, the current indicator value can be generated by converting this current into a voltage by the second resistor.

The excess signal generation circuit may comprise: a second differential amplifier circuit which amplifies a difference between the current indicator value and the current limit reference value so as to generate the excess signal; and a mirror circuit which generates a mirror excess signal obtained by amplifying the excess signal by a predetermined factor, wherein the voltage control signal is controlled by the mirror excess signal. The magnitude of the mirror excess signal with respect to the excess signal may be set by regulating the predetermined factor of the mirror circuit.

In this case, the degree of control of the voltage control signal is adjusted by adjusting a mirror ratio so that the current vs. voltage plot (dropping characteristic) of the power supply apparatus is adjusted accordingly. Further, by regulating the level of gentleness of the drop occurring in the overcurrent limiting operation, using a mirror circuit with a configurable coefficient K or the like, oscillation allowance for protecting against oscillation due to the current limiting operation is properly secured.

The constant voltage control circuit, the current detection circuit and the excess signal generation circuit may be provided in a single integrated circuit, and the current detection resistor and the control transistor may be provided external to the integrated circuit. The booster circuit of a charge pump type, the constant voltage control circuit, the current detection circuit and the excess signal generation circuit may be provided in a single integrated circuit, and the current detection resistor and the control transistor may be provided external to the integrated circuit.

By providing the current detection resistor and the control transistor external to the IC, it is easy to adjust resistance. The current limit value can be regulated in accordance with the load, without modifying the IC.

The present invention according to yet another aspect provides an electronic appliance. The electronic appliance according to this aspect comprises: a battery; a light-emitting device; and a power supply apparatus according to claim 1 which receives a voltage of the battery as an input voltage and supplies a drive voltage to the light-emitting device.

According to this aspect, a current in excess of a current limit value can be supplied to a light-emitting device so that oscillation occurring in this process is prevented.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
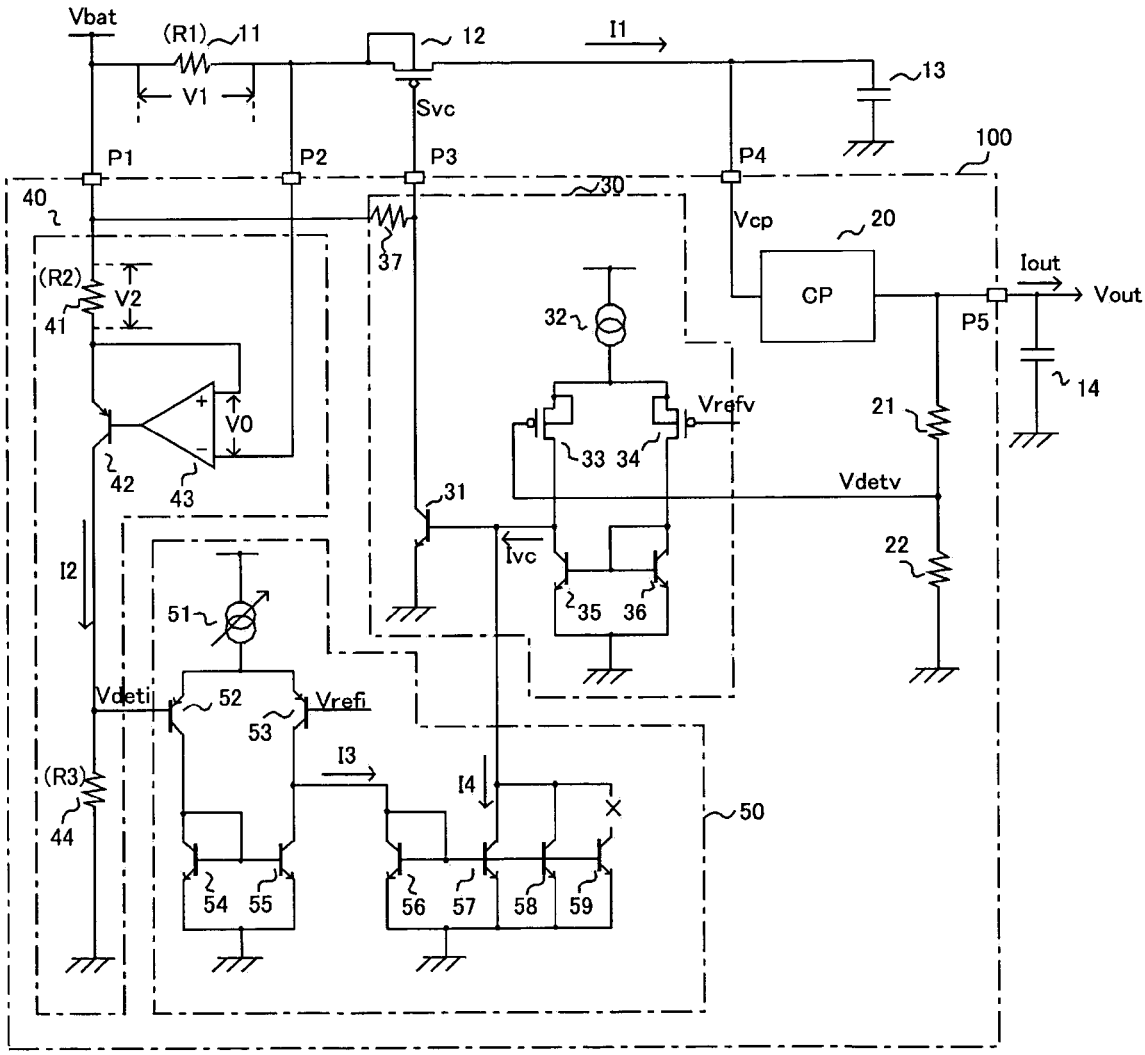
FIG. 1 illustrates the structure of a power supply apparatus according to an example of the present invention.
Figure 2:
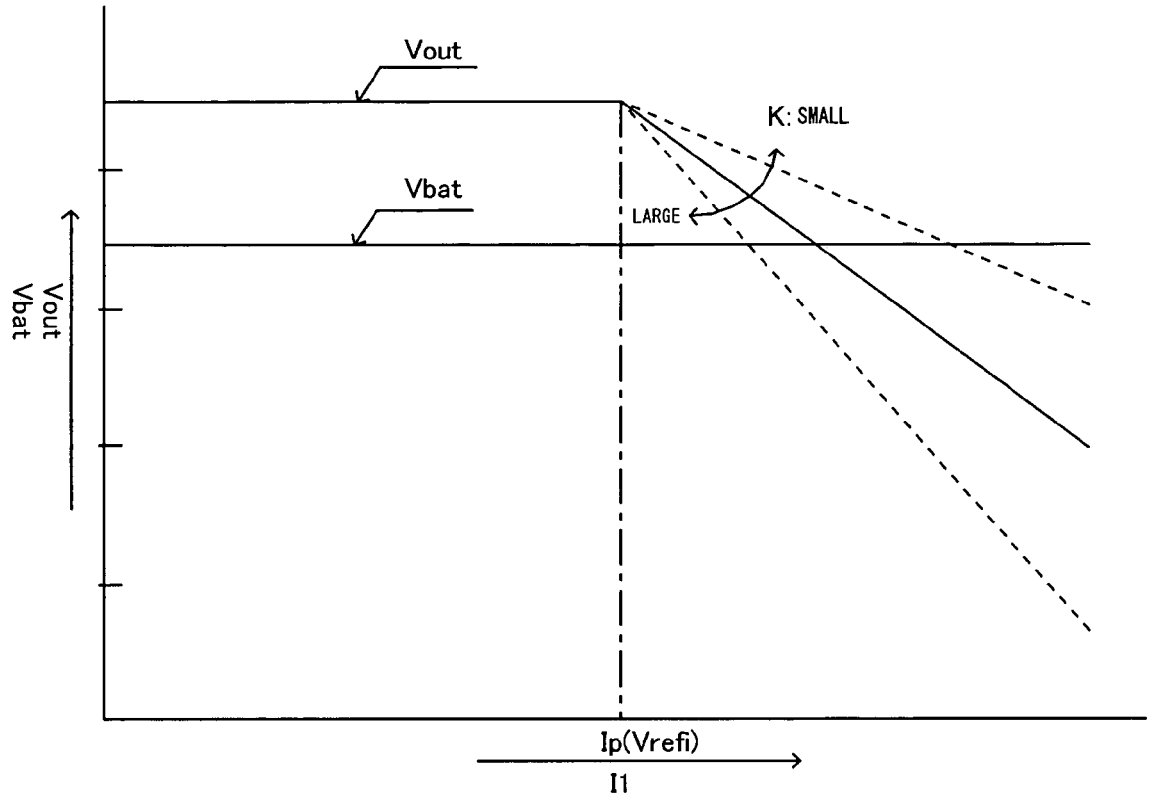
FIG. 2 is a graph of voltage vs. current of the power supply apparatus of FIG. 1.
Figure 3:
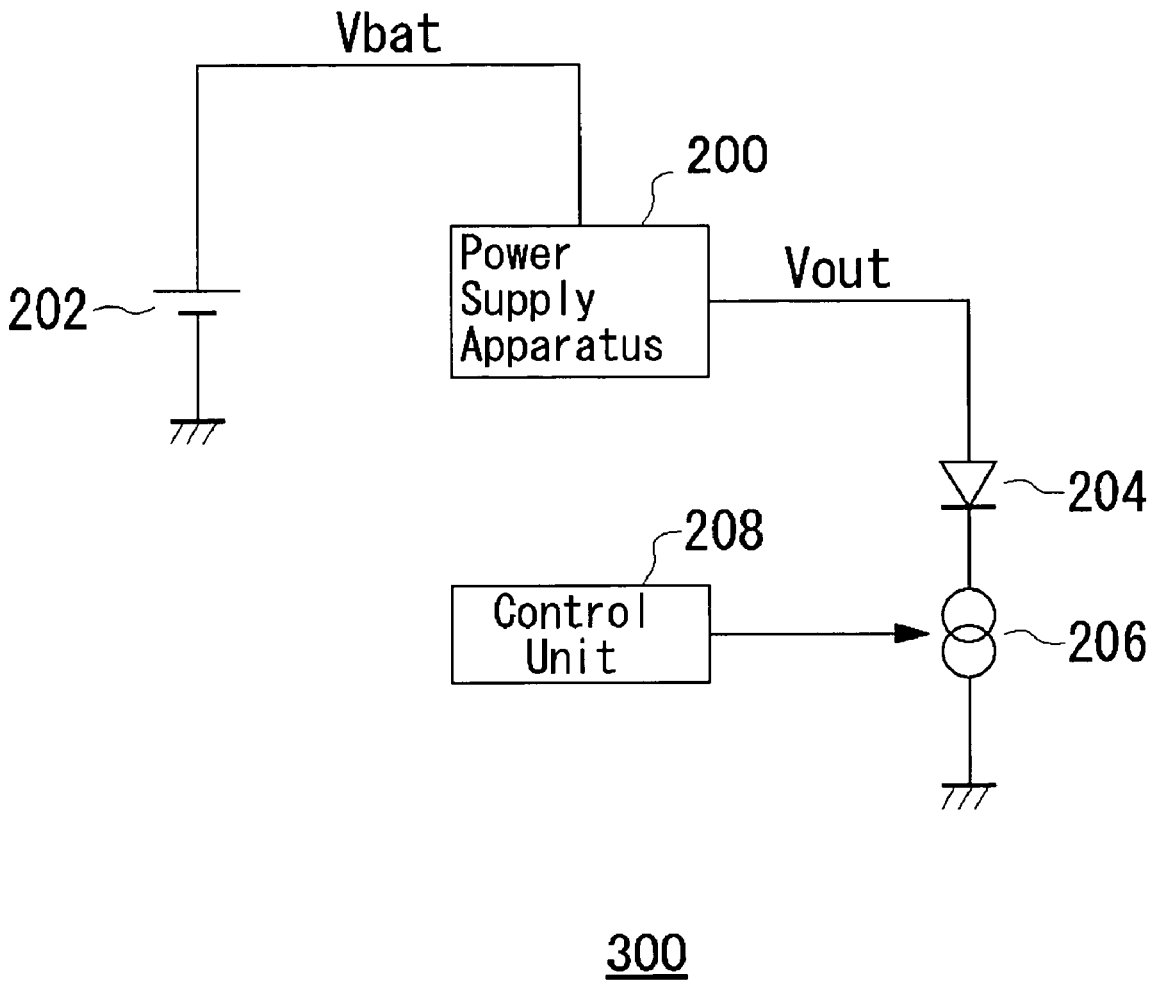
FIG. 3 is a block diagram illustrating the structure of an electronic appliance in which the power supply apparatus of FIG. 1 is installed.

A description will now be given, with reference to the attached drawings, of an example of power supply apparatus according to the present invention. FIG. 1 illustrates the structure of a power supply apparatus 200 according to an example of the present invention. FIG. 2 is a graph of voltage vs. current of the power supply apparatus of FIG. 1, or a graph illustrating a relation between an output voltage Vout and a main circuit current I1. FIG. 3 is a block diagram illustrating the structure of an electronic appliance 300 in which the power supply apparatus 200 of FIG. 1 is installed.

The electronic appliance 300 of FIG. 3 is, for example, a cell phone. The electronic appliance 300 comprises the power supply apparatus 200, a battery 202, an LED 204, a constant current circuit 206 and a control unit 208. The battery 202 outputs a battery voltage Vbat. The power supply apparatus 200 boosts the battery voltage Vbat so as to output a drive voltage Vout to the anode of the LED 204. The constant current circuit 206 is provided between the cathode of the LED 204 and the ground so as to generate a constant current to feed through the LED 204 and causes the LED 204 to emit light of desired luminance. The control unit 208 is a block for integrally controlling the electronic appliance 300 as a whole. The constant current circuit 206 generates a constant current by referring to a current value designated by the control unit 208 so as to control the luminance of the LED 204. The LED 204 is provided as a backlight for a liquid crystal panel or a light emitting apparatus for letting a user know an incoming call by being lighted when a call arrives.

Referring back to FIG. 1, the power supply apparatus 200 comprises a current detection resistor 11, a main control transistor 12, an IC 100 and smoothing capacitors 13 and 14. The power supply apparatus 200 boosts the battery voltage Vbat so as to output a predetermined output voltage Vout.

Referring to FIG. 1, a voltage drop V1 commensurate with a main circuit current I1 fed through the current detection resistor 11 occurs across the current detection resistor 11. The current detection resistor 11 is of a low resistance R1 in order to reduce loss. For example, R1 may of 0.05Ω. The current detection resistor 11 may be formed as a component external to an IC and regulated to have an appropriate resistance in accordance with a desired current limit value.

The main control transistor 12 is a control element in a series regulator. In this example, a p-type MOS field effect transistor (hereinafter, referred to as a PMOS transistor) is used. An NMOS transistor, a PNP bipolar transistor (hereinafter, referred to as a PNP transistor), a NPN bipolar transistor (hereinafter, referred to as an NPN transistor) or a control element of other types may be used as the main control transistor 12.

The main control transistor 12 is connected in series with the current detection resistor 11. The level of conduction is controlled by a voltage control signal Svc. The main control transistor 12 regulates the input voltage Vbat so as to output a regulated voltage Vcp. The input voltage Vbat, if supplied from a battery power source or the like, inherently varies in voltage level within a certain range. For example, the input voltage varies within a range of 3.0–4.5V. The smoothing capacitor 13 reduces variation of the main circuit current I1 or the like occurring in association with the boosting of the regulated voltage Vcp from the main control transistor 12 by booster circuit 20 of a charge pump type.

In this example, the regulated voltage Vcp is boosted by the booster circuit 20 of a charge pump type so as to output an output voltage Vout (for example, the predetermined output voltage value may be 4.75V).

As known in the art, the booster circuit 20 of a charge pump type is provided with a charge pump means in which a plurality of charge pump units are connected in series, the charge pump unit comprising a switch (or a diode) and a capacitor. In association with the charge pump operation, the current and the voltage at the input end and the output end of the booster circuit 20 vary. The variation at the input end is canceled by the smoothing capacitor 13. The variation at the output end is canceled by the smoothing capacitor 14.

In addition to the booster circuit 20 of a charge pump type, the IC 100 comprises voltage division resistors 21 and 22 for obtaining a voltage indicator value Vdetv by dividing the output voltage Vout, a constant voltage control circuit 30 for generating the voltage control signal Svc, a current detection circuit 40 for generating a current indicator value Vdeti proportional to the main circuit current I1 and an overcurrent generation circuit 50 for generating a mirror overcurrent (extraction current) I4 commensurate with an overcurrent (excess signal) I3 beyond the current limit value Ip (current limit reference value Vrefi). The current detection circuit 40 and the overcurrent generation circuit 50 constitute a current limitation control circuit. P1–P5 denote terminals of the IC 100.

The constant voltage control circuit 30 is provided with a differential amplification circuit which receives a voltage reference value Vrefv and a voltage indicator value Vdetv and which generates a current signal Ivc commensurate with a difference between the voltage reference value Vrefv and the voltage indicator value Vdetv. The differential amplifier circuit supplies a current signal Ivc to the base of an NPN transistor 31 connected between the gate of the main control transistor 12 and the ground. A resistor 37 is connected between the gate of the main control transistor 12 and the terminal P1 to which the input voltage Vbat is applied. Accordingly, the voltage control signal Svc varies with the current signal Ivc and controls the main control transistor 12 accordingly.

The differential amplifier circuit includes PMOS transistors 33 and 34 constituting a differential pair, NPN transistors 35 and 36 constituting a current mirror load, and a constant current source circuit 32 for supplying a tail current. The voltage reference value Vrefv is applied to the gate of the PMOS transistor 34. The voltage indicator value Vdetv is applied to the gate of the PMOS transistor 33. The constant current source circuit 32 is connected to the sources of the PMOS transistors 33 and 34. The NPN transistors 35 and 36 are connected to the drains of the PMOS transistors 33 and 34, respectively. A current signal Ivc, obtained by amplifying an error between the voltage reference value Vrefv and the voltage indicator value Vdetv, is output from a node in a series connection between the PMOS transistor 33 and the NPN transistor 35.

The current detection circuit 40 is configured such that a first resistor 41 (resistance R2), a conversion transistor 42 (PNP transistor) and a second resistor 44 (resistance R3) are connected in series in the stated order between an end of the current detection resistor 11 (input voltage Vbat node) and a reference potential node (ground). A node between the first resistor 41 and the conversion transistor 42 is connected to the non-inverting input of an operational amplifier 43. The other end of the current detection resistor 11 is connected to the inverting input of the operational amplifier 43. Since the operational amplifier 43 operates as an ideal amplifier, a voltage V0 between the two inputs approaches 0 by a feedback operation. With this, a voltage drop V2 (=I2·R2) of the first resistor 41 is equal to the voltage drop V1 (=I1·R1) of the current detection resistor 11.

An indicator current I2 is given by I2=I1·(R1/R2). Given that the resistance R2 is, for example, 5 kΩ, the indicator current I2 is 7.4 μA when the main circuit current I1 is 740 mA. The indicator current I2 is fed through the second resistor 44 so as to create the current indicator value Vdeti. Given that the resistance R3 is, for example, 50 kΩ, the current indicator value Vdeti is 0.37V.

The overcurrent generation circuit 50 receives the current indicator value Vdeti and the predetermined current limit reference value Vrefi, and generates an overcurrent I3 commensurate with an excess of the current indicator value Vdeti over the current limit reference value Vrefi, using a differential amplifier circuit.

The differential amplifier circuit includes PNP transistors 52 and 53 constituting a differential pair, NPN transistors 54 and 55 constituting a current mirror load, and a constant current source circuit 51 for supplying a tail current. The current indicator value Vdeti and the current limit reference value Vrefi are applied to the gates of the PNP transistors 52 and 53, respectively. The constant current source circuit 51 is connected to the emitters of the PNP transistors 52 and 53. The collectors of the NPN transistors 54 and 55 are connected to the collectors of the PNP transistors 52 and 53, respectively. The differential amplifier circuit applies differential amplification to the current indicator value Vdeti and the current limit reference value Vrefi so as to output an overcurrent I3 from the node in a series connection between the PNP transistor 53 and the NPN transistor 55.

There are also provided current mirror circuits (56–59) for generating a current mirror output current (current mirror destination current) obtained by receiving the-overcurrent I3 as the current mirror input current (current mirror source current) and by amplifying it by a predetermined factor K, the current mirror output current being generated as the mirror overcurrent (extraction current) I4.

The current mirror circuit as described above comprises an NPN transistor 56 having its collector and base connected to each other and provided at the current mirror input (current mirror source) to which the overcurrent I3 is input. The current mirror circuit also comprises, at the current mirror output (current mirror destination), NPN transistors 57, 58 and 59 which have their bases connected to the base of the NPN transistor 56, and through which flows a current commensurate with a current mirror ratio. The NPN transistors 57, 58 and 59 are configured such that their current paths are independently blocked by, for example, trimming.

In the illustrated example, there are provided three NPN transistors at the current mirror output. The emitters of two of them, i.e., the NPN transistors 57 and 58, are connected in parallel so as to generate a mirror overcurrent I4. The collector of one of the transistors, i.e., the transistor 59, is open.

Thus, by preparing a plurality of transistors at the current mirror output and connecting a predetermined number of them in parallel, the current mirror ratio inside the IC is regulated.

The collectors of the NPN transistors 57 through 59 are connected to the base of the NPN transistor 31 of the constant voltage control circuit 30. Consequently, the base current of the NPN transistor 31 is a current obtained by subtracting the mirror overcurrent I4 generated by the overcurrent generation circuit 50 from the current signal Ivc generated by the constant voltage control circuit 30.

With this, the slope of output voltage Vout vs. main circuit current I1 plot (dropping characteristic) can be regulated as required. The slope of the output voltage Vout vs. main circuit current I1 plot (dropping characteristic) can also be regulated by varying the overcurrent I3 by regulating the constant current value of the constant current source circuit 51.

The operation of the above power supply apparatus will be described with reference to the drawings including FIG. 2. The booster circuit 20 of a charge pump type boosts the input regulated voltage Vcp by a predetermined gain so as to output the output voltage Vout smoothed out by the smoothing capacitor 14.

The predetermined gain (boosting gain) of the booster circuit 20 of a charge pump type is not constant due to internal voltage drop etc. The voltage indicator value Vdetv obtained by dividing the output voltage Vout is compared with the voltage reference value Vrefv. The main control transistor 12 is controlled by the voltage control signal Svc so that the difference detected by the comparison becomes zero. With this, the output voltage is maintained at a predetermined constant value (predetermined value) even when the voltage drop inside the booster circuit 20 varies.

The mirror overcurrent I4 is not generated until the main circuit current I1 reaches the current limit value Ip defined by the current limit reference value Vrefi. Therefore, the voltage control signal Svc is solely determined by the operation of the constant voltage control circuit 30. Accordingly, constant voltage control for maintaining the output voltage Vout at the predetermined value is performed.

When the load is increased (heavy load) or a short circuit failure occurs at the load, the output current Iout is increased, causing the main circuit current I1 to be increased as a result.

When the main circuit current I1 is increased beyond the current limit value Ip (current limit reference value Vrefi), the overcurrent I3 commensurate with the excess is generated so that the mirror overcurrent I4 obtained by amplifying the overcurrent I3 by the predetermined factor K is generated. The mirror overcurrent I4 is extracted from the current signal Ivc.

As a result of this, the level of conduction of the NPN transistor 31 for generation of the voltage control signal is lowered. Since the current through the NPN transistor 31 is fed thereto via the resistor 37, the voltage drop in the resistor 37 is lowered so that the voltage control signal Svc is increased. Since the gate-source voltage of the main control transistor 12 is reduced in this process, the level of conduction of the main control transistor 12 is lowered so that the regulated voltage Vcp is lowered accordingly. As the regulated voltage Vcp is lowered, the output voltage Vout is also lowered.

As indicated by the output voltage Vout vs. main circuit current I1 plot of FIG. 2, the slope of the output voltage Vout plot (dropping characteristic) in a range in which the main circuit current I1 exceeds the current limit value Ip (current limit reference value Vrefi) is gentle. Accordingly, while the output voltage Vout drops in a range in which the main circuit current I1 exceeds the current limit value Ip, the output current Iout continues to be supplied under the condition of the dropped output voltage Vout.

Since the slope of the drop of the output voltage Vout is gentle, the inventive power supply apparatus is prevented from entering a condition of oscillation in which generation of an overcurrent and suspension of an output current are repeated, unlike the related-art power supply apparatus.

Further, by regulating the level of gentleness of the drop occurring in the overcurrent limiting operation, using a mirror circuit with a configurable coefficient K or the constant current source circuit 51, oscillation allowance for protecting against oscillation due to the current limiting operation is properly secured.

Constant voltage operation is performed such that, when the input voltage Vbat drops due to the consumption of a battery, the level of conduction of the main control transistor 12 is controlled in accordance with the degree of drop so that a predetermined output voltage Vout is output.

For example, when the main control transistor 12 enters a saturated state, the output voltage Vout, obtained by boosting the voltage occurring at that point of time by the booster circuit 20 of a charge pump type, is output.

Since an overcurrent is detected as the current detection resistor 11 is connected in series with the main control transistor 12 of the series regulator, the current limiting operation by the current limitation control circuit is performed independent of the creation of the voltage control signal by the constant voltage control circuit 30. Even when the main control transistor 12 is in a saturated state, the current limiting operation is performed with reference to the predetermined current limit value Ip.

Since the current detection resistor 11 is externally coupled to the IC 100, the current limit value Ip can be regulated in accordance with the load connected, without modifying the structure of the IC 100.

In the example above, a description was given of the structure provided with the booster circuit 20 of a charge pump circuit. The present invention is equally applicable to a power supply apparatus of a series type in which the booster circuit 20 of a charge pump type as used in the example of FIG. 1 is removed.

While the preferred embodiments of the present invention have been described using specific terms, such description is for illustrative purposes only, and it is to be understood that changes and variations may be made without departing from the spirit or scope of the appended claims.

What is claimed is:

1. A power supply apparatus comprising:

a control transistor which is controlled by a voltage control signal and which outputs an output voltage by regulating an input voltage;

a constant voltage control circuit which receives a predetermined voltage reference value and a voltage indicator value commensurate with the output voltage, and which generates the voltage control signal in accordance with a difference between the voltage reference value and the voltage indicator value;

a current detection resistor provided in a current path of the control transistor;

a current detection circuit which generates a current indicator value commensurate with a voltage drop in the current detection resistor; and an excess signal generation circuit which receives the current indicator value and a predetermined current limit reference value, generates an excess signal commensurate with an excess of the current indicator value over the current limit reference value, and controls the voltage control signal in accordance with the excess signal.

2. A power supply apparatus comprising:

a control transistor which is controlled by a voltage control signal and which outputs a regulated voltage by regulating an input voltage;

a booster circuit of a charge pump type which receives the regulated voltage and boosts the regulated voltage so as to output an output voltage accordingly;

a constant voltage control circuit which receives a predetermined voltage reference value and a voltage indicator value commensurate with the output voltage, and which generates the voltage control signal in accordance with a difference between the voltage reference value and the voltage indicator value;

a current detection resistor provided in a current path of the control transistor;

a current detection circuit which generates a current indicator value commensurate with a voltage drop in the current detection resistor; and an excess signal generation circuit which receives the current indicator value and a predetermined current limit reference value, generates an excess signal commensurate with an excess of the current indicator value over the current limit reference value, and controls the voltage control signal in accordance with the excess signal.

3. The power supply apparatus according to claim 1, wherein the excess signal generation circuit shifts the voltage control signal in a direction in which the control transistor is turned off, in accordance with the excess signal.

4. The power supply apparatus according to claim 2, wherein the excess signal generation circuit shifts the voltage control signal in a direction in which the control transistor is turned off, in accordance with the excess signal.

5. The power supply apparatus according to claim 1, wherein the constant voltage control circuit comprises:

a first differential amplifier circuit which amplifies a difference between the voltage reference value and the voltage indicator value; and a voltage control signal generation transistor which is controlled by an output of the first differential amplifier circuit so as to generate the voltage control signal.

6. The power supply apparatus according to claim 2, wherein the constant voltage control circuit comprises:

a first differential amplifier circuit which amplifies a difference between the voltage reference value and the voltage indicator value; and a voltage control signal generation transistor which is controlled by an output of the first differential amplifier circuit so as to generate the voltage control signal.

7. The power supply apparatus according to claim 1, wherein the current detection circuit comprises:

a first resistor which is connected in series between an end of the current detection resistor and a reference potential node;

a conversion transistor;

a second resistor; and an operational amplifier which receives a potential difference between a node connecting the first resistor and the conversion transistor and the other end of the current detection resistor, and which controls the conversion transistor by an output of the operational amplifier, wherein a voltage drop in the second resistor is used as the current indicator value.

8. The power supply apparatus according to claim 2, wherein the current detection circuit comprises:

a first resistor which is connected in series between an end of the current detection resistor and a reference potential node;

a conversion transistor;

a second resistor; and an operational amplifier which receives a potential difference between a node connecting the first resistor and the conversion transistor and the other end of the current detection resistor, and which controls the conversion transistor by an output of the operational amplifier, wherein a voltage drop in the second resistor is used as the current indicator value.

9. The power supply apparatus according to claim 1, wherein the excess signal generation circuit comprises:

a second differential amplifier circuit which amplifies a difference between the current indicator value and the current limit reference value so as to generate the excess signal; and a mirror circuit which generates a mirror excess signal obtained by amplifying the excess signal by a predetermined factor, wherein the voltage control signal is controlled by the mirror excess signal.

10. The power supply apparatus according to claim 2, wherein the excess signal generation circuit comprises:

a second differential amplifier circuit which amplifies a difference between the current indicator value and the current limit reference value so as to generate the excess signal; and a mirror circuit which generates a mirror excess signal obtained by amplifying the excess signal by a predetermined factor, wherein the voltage control signal is controlled by the mirror excess signal.

11. The power supply apparatus according to claim 9, wherein the magnitude of the mirror excess signal with respect to the excess signal is set by regulating the predetermined factor of the mirror circuit.

12. The power supply apparatus according to claim 10, wherein the magnitude of the mirror excess signal with respect to the excess signal is set by regulating the predetermined factor of the mirror circuit.

13. The power supply apparatus according to claim 1, wherein the constant voltage control circuit, the current detection circuit and the excess signal generation circuit are provided in a single integrated circuit, and the current detection resistor and the control transistor are provided external to the integrated circuit.

14. The power supply apparatus according to claim 2, wherein the booster circuit of a charge pump type, the constant voltage control circuit, the current detection circuit and the excess signal generation circuit are provided in a single integrated circuit, and the current detection resistor and the control transistor are provided external to the integrated circuit.

15. An electronic appliance comprising:

a battery;

a light-emitting device; and a power supply apparatus according to claim 1 which receives a voltage of the battery as an input voltage and supplies a drive voltage to the light-emitting device.

16. An electronic appliance comprising:

a battery;

a light-emitting device; and a power supply apparatus according to claim 2 which receives a voltage of the battery as an input voltage and supplies a drive voltage to the light-emitting device.

* * * * *